US005578886A

United States Patent [19]

Holmlid et al.

[11] Patent Number: 5,578,886

[45] Date of Patent: Nov. 26, 1996

[54] COLLECTOR FOR THERMIONIC ENERGY CONVERTER COVERED WITH CARBON LIKE MATERIAL AND HAVING A LOW ELECTRONIC WORK FUNCTION

[76] Inventors: Leif Holmlid, S-435 31, Mölnlycke; Robert Svensson, S-438 93, Landvetter, both of Sweden

[21] Appl. No.: 190,049

[22] PCT Filed: Jul. 29, 1992

[86] PCT No.: PCT/SE92/00530

§ 371 Date: Jan. 31, 1994

§ 102(e) Date: Jan. 31, 1994

[87] PCT Pub. No.: WO93/03494

PCT Pub. Date: Feb. 18, 1993

[30] Foreign Application Priority Data

Jul. 31, 1991 [SE] Sweden ..... 9102263

[51] Int. Cl.[6] ..... H01J 45/00

[52] U.S. Cl. ..... 310/306

[58] Field of Search ..... 310/306, 307, 310/304, 305; 322/2 R, 2 A

[56] References Cited

U.S. PATENT DOCUMENTS

| | | | |
|---|---|---|---|
| 3,281,372 | 10/1966 | Hass | 310/306 U X |
| 3,376,437 | 4/1988 | Meyerand, Jr. | 310/306 U X |
| 4,747,998 | 5/1988 | Barrus | 310/306 |
| 5,028,835 | 7/1991 | Fitzpatrick | 310/306 |

FOREIGN PATENT DOCUMENTS 2059891 6/1972 Germany .

OTHER PUBLICATIONS

"Thermionic Energy Conversion, vol. I: Processes and Devices", by G. N. Hatsopoulos and E. P. Gyftopoulos, The Massachusetts Institute of Technology, 1973, pp. 5–27.

"Thermionic Energy Conversion, vol. II: Theory, Technology and Application", by G. N. Hatsopoulos and E. P. Gyftopoulos, The MIT Press, Cambridge, MA, 1979, pp. 517–571.

"Large Fluxes of Highly Excited Caesium Ions From a Diffusion Source", by Tony Hansson et al., J. Phys. B: At. Mol. Opt. Phys. 23, 1990, pp. 2163–2171.

"Ryderberg States of Cesium in the Flux From Surfaces at High Temperatures", by Jan B. C. Petterson and Leif Holmlid, Surface Science 211/212, 1989, pp. 263–270.

"Rate Constants for Cesium Bulk Diffusion and Neutral Desorption on Pyrolytic Graphite Basal Surfaces: A Field Reversal Kinetic Study", by Kenneth Möller and Leif Holmid, Surface Science 204, 1988, pp. 98–112.

Möller et al., "Rate Constants for Cesium Bulk Diffusion and Neutral Desorption on Pyroltyic Graphite Basal Surfaces: A Field Reversal Kinetic Study," *Surface Science* 204:98–112 (1988).

Pettersson et al., "Rydberg States of Cesium in the Flux from Surfaces at High Temperatures," *Surface Science* 211/212:263–270 (1989).

Hansson et al., "Large Fluxes of Highly Excited Caesium Ions from a Diffusion Source," *J. Phys. B: At. Mol. Opt. Phys.* 23:2163–2173 (1990).

*Primary Examiner*—Steven L. Stephan
*Assistant Examiner*—Christopher Cuneo
*Attorney, Agent, or Firm*—Klarquist Sparkman Campbell Leigh & Whinston, LLP

[57] ABSTRACT

Collector for thermionic energy converter of a new type with low electronic work function. A thermionic energy converter includes an emitter and a collector and a space provided therebetween to which is supplied vapor of a thermionic material, for example cesium or other alkali metal. The emitter is heated from an external heat source so that it emits electrons to the collector. The collector is at least partly covered by a thin layer of a material, for example carbon, which is capable of interacting with the thermionic material and form excited states of this and maintain a layer of excited thermionic material on the surface of the collector. The new collector for thermionic converters exhibits a very low work function, which implies diminished losses is the energy conversion.

12 Claims, 4 Drawing Sheets

COLLECTOR FOR THERMIONIC ENERGY CONVERTER COVERED WITH CARBON LIKE MATERIAL AND HAVING A LOW ELECTRONIC WORK FUNCTION

TECHNICAL FIELD

The present invention refers to a new design of the collector in a thermionic energy converter. Such a converter consists of two electrodes: an emitter and a collector and a space provided therebetween to which is supplied vapor of a thermionic material, for example cesium or other alkali metal. When the emitter is heated it emits electrons to the collector, so that a current can be taken out by means of an external circuit between the collector and the emitter. In this way the thermal energy at the emitter is converted to electric energy.

BACKGROUND OF THE INVENTION

Thermionic energy converters are used to convert thermal energy at temperatures between 1200 K. and 2500 K. to electric energy without mechanical movable parts. A thermionic converter works as a heat machine between above stated source temperature and a drain temperature of typically 800 K. The converter consists of two electrodes of metal or other appropriate conducting material, one of them at the source temperature, the emitter, and the other at the drain temperature, the collector. The electrodes are located near each other in a vacuum or at low pressure, and the emitter emits a current of electrons to the collector, by it being held at a higher temperature through supply of thermal energy from the outside, for example from a flame or other heat source. The electrodes frequently constitute a part of the external vacuum tight wall or shroud of the converter, and are separated by insulating material. In thermionic converters cesium vapor is normally used with a pressure of magnitude of 1 mbar to increase the electron emission from the emitter and to reduce the problems with space charge in the converter, so that larger current densities can be obtained from the converter. The emission from the emitter is increased by cesium lowering the work function for the electrons from the surface. In the same manner the work function is decreased on the collector, which has very great importance for the function of the converter. Detailed descriptions of thermionic converters are found in the references: G. N. Hatsopoulos and E. P. Gyftopoulos, Thermionic Energy Conversion, Vol. I (MIT Press, Cambridge, Mass., 1973) as well as G. N. Hatsopoulos and E. P. Gyftopoulos, Thermionic Energy Conversion, Vol. II (MIT Press, Cambridge, Mass. 1979).

When the converter gives an output the work function of the collectors corresponds to a loss, i.e. the electrons from the emitter lose the corresponding energy in the form of heat in the collector. The factor of merit for thermionic converters, the so called barrier index, is composed of the work function of the collector and the so called arc voltage drop in the converter. The barrier index is positive and must be as small as possible. These two parts in the barrier index represent the main losses in the converter during normal operation. The work function of the collector normally gives the largest contribution to the barrier index, and a low work function of the collector is consequently of extremely great importance for the manufacture of efficient thermionic converters. Frequently simple metals are used with work functions of 4–5 eV as collector material, for example molybdenum. In operation such a collector is covered with a thin layer of cesium metal (smaller than a simple layer of atoms, a so called monolayer) or of cesiumoxid. This layer lowers the work function of the collector to 1.6–1.8 eV in normal operation.

It is further known for example through the U.S. Pat. No. 4,747,998, that it is possible to keep an alkali metal such as cesium in a graphite container to obtain a regulated pressure of alkali metal in a thermionic converter.

The purpose of the invention and its most important features

The purpose of the present invention is to achieve a thermionic energy converter of the type mentioned in the introduction, which exhibits a very low work function of the collector which entails a more effective energy conversion in the thermionic converter. This has been achieved by the collector at least partly being covered by a thin layer of a material, for example carbon, which is able to interact with said thermionic material and form electronic excited states of this, and that by operation a layer of excited thermionic material is maintained on the collector surface.

SPECIFICATION OF DRAWINGS

In the following the invention will be closer described with reference to an embodiment shown on the enclosed drawings.

SPECIFICATION OF EMBODIMENTS

The collector 1 consists of a metal foil with small holes through the foil, whereby in the experimental plant the distance between the holes was typically 0.2 mm and the hole diameter 0.1 mm, i.e. a hole density of 25 per $mm^2$. The holes have been bored by means of a laser. Through the foil vapor of cesium or other thermionic material is brought, for example an other alkali metal, to flow with a pressure of about 1 mbar (equilibrium pressure at a temperature of 300° C.). The external surface of the foil is coated with a very thin layer of carbon, for example in the form of graphite. The carbon can be supplied through for example chemical disintegration of hydrocarbon or through mechanical coating with graphite in colloidal form on adjacant surface. Possibly the carbon in the coating reacts with the collector material and forms a carbide. Through interaction between the cesium vapor and the carbon coated surface high-energy, so called excited states of cesium atoms and cesium ions are formed. This mechanism is documented in the references: K. Möller and L. Holmlid, Surface Sci. 204 (1988) 98, J. B. C. Pettersson and L. Holmlid, Surface Sci. 211 (1989) 263 and T. Hansson, C. Åman, J. B. C Pettersson and L. Holmlid, J. Phys. B. 23 (1990) 2163.

These states interact so strongly with each other that a layer of excited cesium can be retained on the foil. The formation of the excited states and the formation of the layer of excited cesium is faciliated by the presence of a hot carbon covered surface in the proximity of the foil, so that further excited states of cesium can be formed. Instead of carbon other materials can be used, which are capable of interacting with cesium (or other thermionic material) in the above stated manner.

Figure 1:
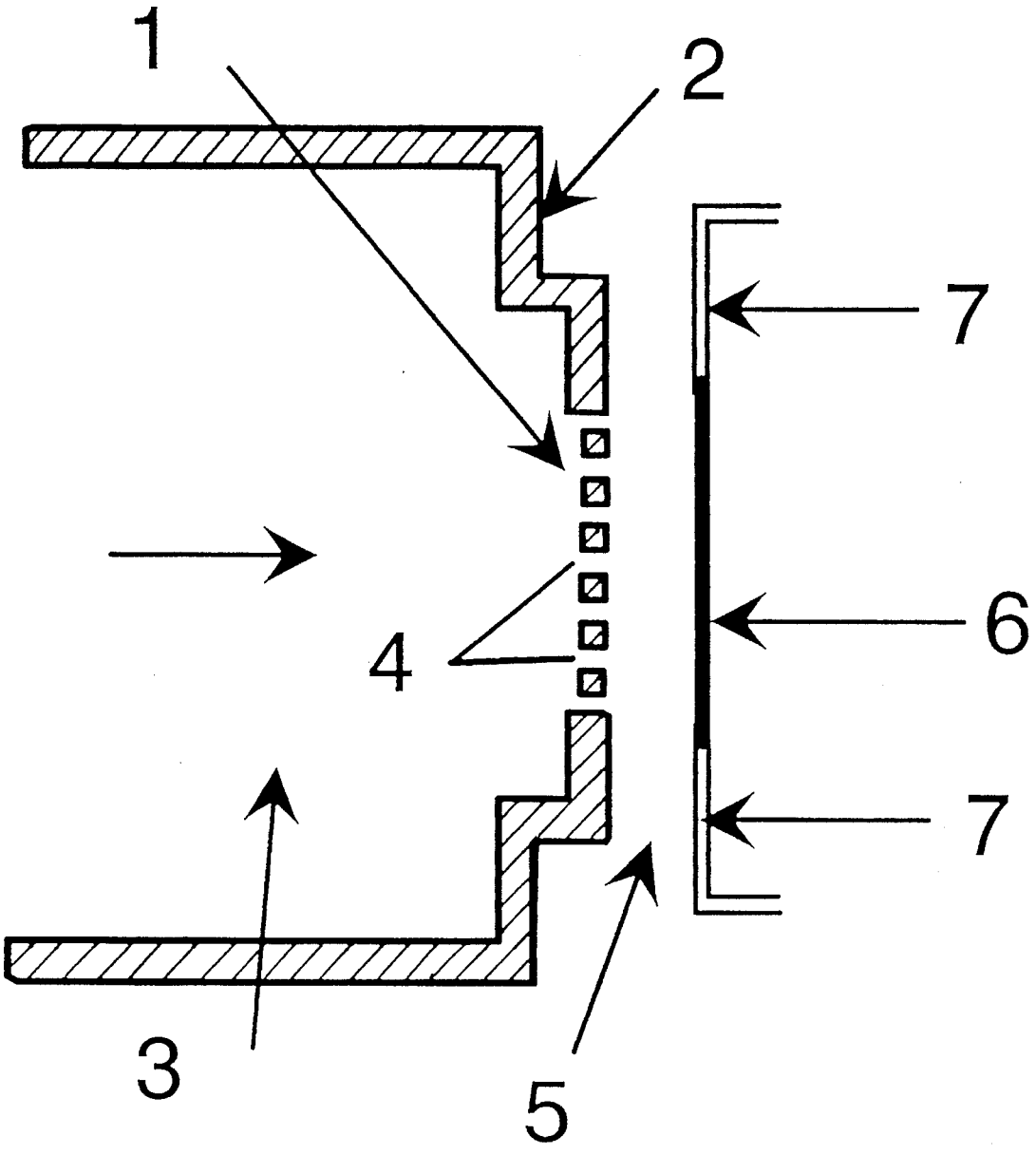
FIG. 1 shows in a schematic vertical section an outline diagram of the collector and emitter in the thermionic converter.

A collector of this type can be realized in several different ways regarding size of the laser bored surface and its form (plane or curved, possibly cylindric). Testing of the collector and measuring of its characteristics has been carried out in an arrangement as is shown in principle in FIG. 1. In this the laser bored foil is welded to a container of stainless steel 2. In the container 3 a vapor pressure of cesium is maintained. The cesium vapor flows through openings 4 in the collector 1, out in the space 5 between the collector and the adjacent hot so called emitter 6. This is held by two legs 7, which also conduct the electric current which heats the emitter.

Figure 2:
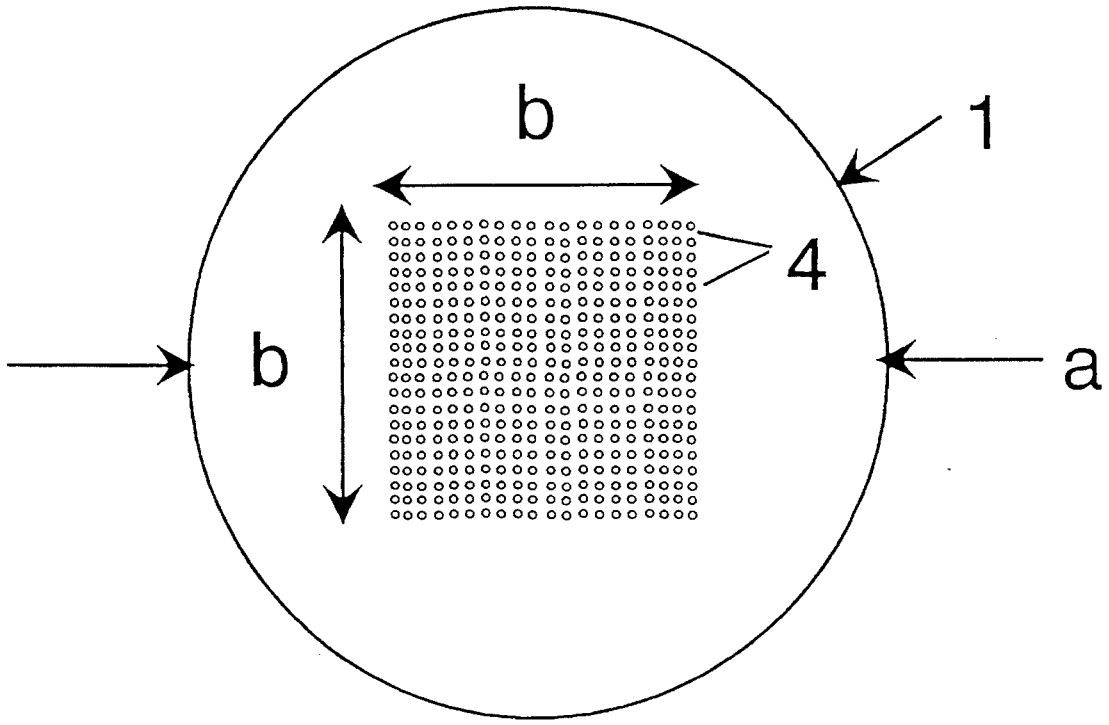
FIG. 2 shows a frontal view of the collector.

The design of the collector in the tests is shown in FIG. 2. It is made of nickel foil with a thickness of 0.5 mm. The external diameter a of the collector is 10 mm, while the laser bored holes lie within a surface b of 4×4 $mm^2$. It should be remarked that these measure statements only consider the actual embodiment, and are in no way limiting for the invention. Colloidal graphite is supplied onto the collector 1 on the part of surface which is not laser bored.

Figure 3:
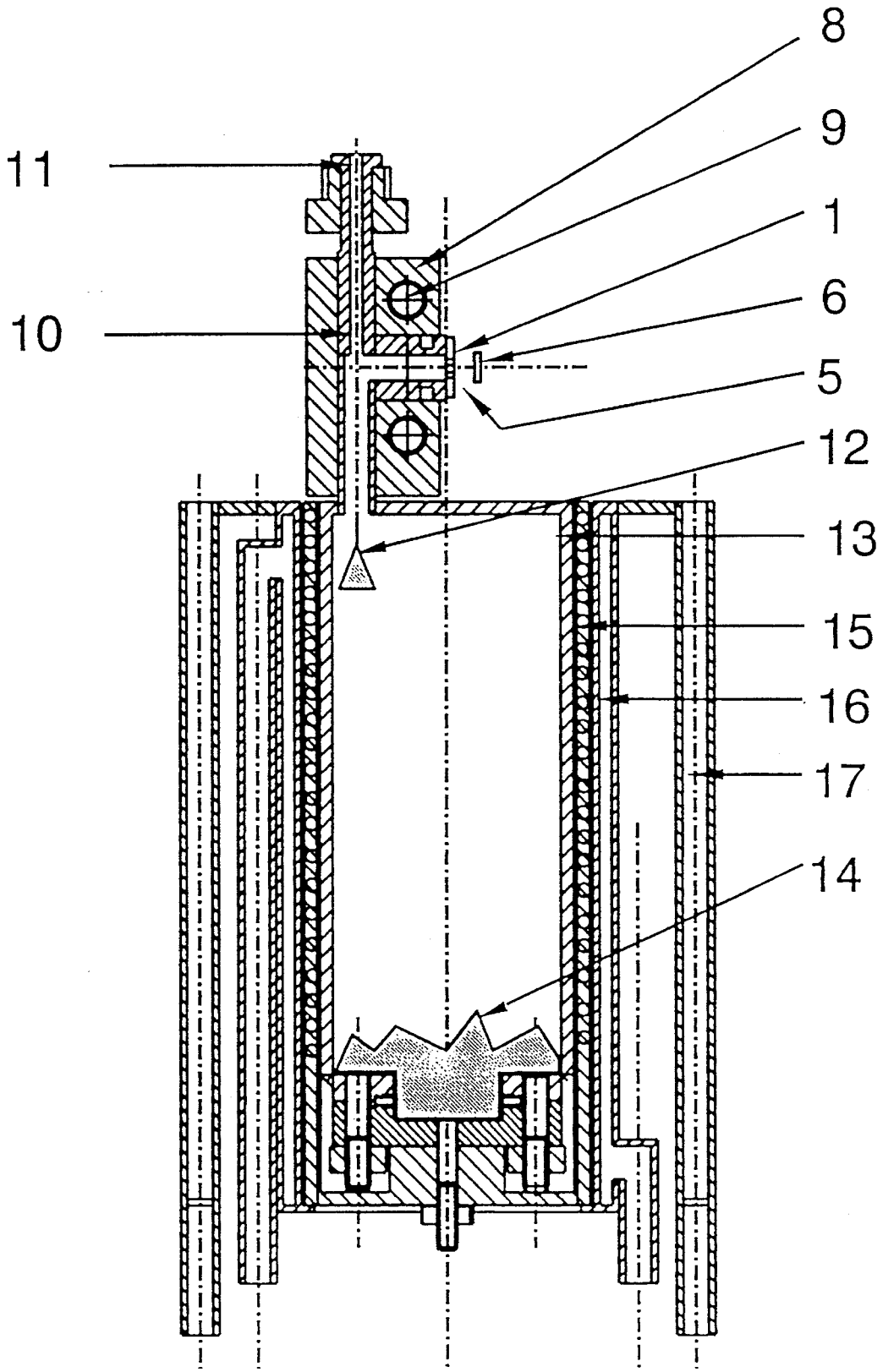
FIG. 3 is a vertical section through the thermionic converter including the cesium container.

The cesium is supplied to the collector from a heated reservoir, such as is shown in FIG. 3. In this figure the cross section of the emitter foil 6 is shown, the collector 1 and a copper casing 8 with a heating-coil 9 which heats the collector to a temperature about 800 K. In the upper part 10 of the device in FIG. 3 there is also a connection 11 for a valve 12, which can be used to interrupt the cesium flow from a lower container 13 to the upper 10. The cesium 14 is introduced in metallic form in the lower container 13, frequently in solid form in a glass vial. The lower container 13 is heated by means of a heat casing 15, which also holds the device in position in the vacuum chamber via an envelope 16 and three legs 17. In order to cool the lower container rapidly air or water can be pressed through the envelope 16.

Figure 4:
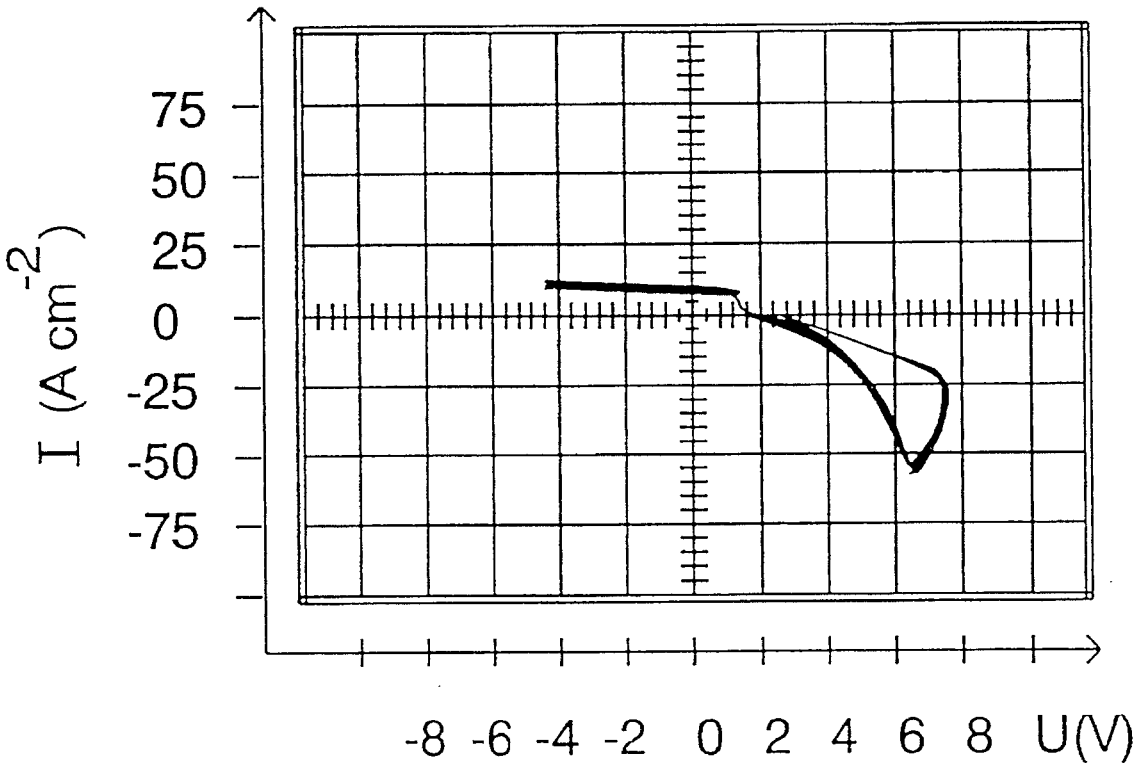
FIG. 4 shows an experimental result in the form of a current—voltage diagram for the thermionic converter.

The thermionic converter according to the invention shows a voltage-current-characteristic which differs from the normal for other thermionic converters. Thus for example an electron current can pass from the collector to the emitter, a so called reverse current, if the converter is connected to a voltage source with reversed polarity compared to the normal polarity when the converter gives output power. This reverse current may reach very large current densities, more than 500 A/$cm^2$. This means that the work function of the collector is smaller than 0.7 eV, from the Richardson equation for thermal electron emission. More detailed analyses of voltage-current-characteristic point at work functions between 0.5 and 0.9 eV. This implies a large reduction of the work function for collectors in thermionic converters, which has not until now been possible to reduce below approximately 1.2 eV. With this new type of collector we have been able to attain barrier induces in a thermionic converter during brief constant operation down to 1.64 eV, for example in the experiment in FIG. 4. In this case the emitter temperature was 1680 K. (1407° C.), the collector temperature 553 K. (280 ° C.) and the distance between emitter and collector about 0.4 mm. The output corresponding to these data is 10 W/$cm^2$, and the work function of the collector is 0.64 eV. Pulsed operation is expected give still lower barrier index. This implies a strong reduction of barrier index from typical published values of 1.8–2.0 eV.

This described improved type for collector of thermionic energy converters exhibits the following characteristics:

work function for electrons is very low from the collector, below 0.7 eV, which implies strongly reduced losses for the energy conversion:

the surface layer of the collector is produced during the use in the converter by high-energy so called excited atoms and ions of cesium forming a layer on the surface of the collector, the excited states are formed on the surface of the collector in a thin carbon layer, which can be supplied by several known methods, the formation of the excited states and the surface layer of excited states on the collector is faciliated through the presence of another hot surface where excited states of cesium can be formed, the low work function of the new the type of collector in a thermionic converter entails reduced losses and reduced so called barrier index, which to a large part consists of the work function of the collector: this implies more effective energy conversion in thermionic energy converters which use this type of collector.

The invention is of course not limited to the embodiment described and shown above but several variants are conceivable within the scope of the patent claims. As an example the collector 1 can be designed without holes 4, and the cesium vapor can be supplied directly to the space 5 between emitter and collector. In order to obtain increased contact between the cesium vapor and the carbon layer of the collector the collector surface can be developed with irregularities such as indentations or bosses which will present a similarly structured surface to the thermionic material. In this case the collector can be made of a thicker material. Possibly even a smooth collector surface can give enough good contact between the cesium vapor and the carbon, for example if the carbon forms thread shaped outgrowths (whiskers) from the collector surface.

We claim:

1. A thermionic converter comprising:

an emitter;

a collector having a surface positioned to receive electrons from said emitter;

vapor of a thermionic material interposed between said collector and said emitter;

wherein the collector is at least partly covered by a thin layer of a material capable of interacting with said thermionic material and forming excited states of said thermionic material such that excited thermionic material is maintained on the surface of the collector, thereby providing a work function of the surface of said collector less than 0.9 eV.

2. The converter of claim 1 wherein the collector is provided with several holes to allow the vapor of said thermionic material to pass through.

3. The converter of claim 1 wherein said thin layer of material on the collector is carbon.

4. The converter of claim 2 wherein said thin layer of material on the collector is carbon.

5. The converter of claim 1 wherein said thin layer of material on the collector is a carbide.

6. The converter of claim 2 wherein said thin layer of material on the collector is a carbide.

7. The converter of claim 1 wherein said thermionic material comprises an alkali metal.

8. The converter of claim 1 wherein said thermionic material comprises cesium.

9. A thermionic energy converter comprising:

an emitter;

a collector having a surface positioned to receive electrons from said emitter; and vapor of a thermionic material interposed between said collector and said emitter;

wherein the collector is at least partly covered by a thin layer of a material capable of interacting with said thermionic material and forming excited states of said thermionic material such that excited thermionic material is maintained on the surface of the collector, and wherein the collector comprises a metal foil including several holes to allow the vapor of said thermionic material to pass through.

10. The thermionic energy converter of claim 9 wherein said thin layer of material comprises a carbide formed after coating the collector with carbon.

11. The thermionic energy converter of claim 9 wherein said thin layer of material comprises carbon formed after coating the collector with carbon.

12. A thermionic converter comprising:

an emitter;

a collector having a surface positioned to receive electrons from said emitter;

vapor of a thermionic material interposed between said collector and said emitter;

wherein the collector is at least partly covered by a thin layer of carbon or carbide capable of interacting with said thermionic material and forming excited states of said thermionic material such that excited thermionic material is maintained on the surface of the collector, thereby providing a work function of the surface of said collector less than 0.9 eV.

* * * * *

UNITED STATES PATENT AND TRADEMARK OFFICE

CERTIFICATE OF CORRECTION

PATENT NO. : 5,578,886

DATED : November 26, 1996

INVENTOR(S) : Holmlid et al.

It is certified that error appears in the above-indentified patent and that said Letters Patent is hereby corrected as shown below:

On the Title page:

In the References Cited:

"4/1988" should read --4/1968--.

In the Other Publications:

"Ryderberg" should read --Rydberg--.

In the Abstract:

Line 13
"losses is the" should read --losses in the--.

In the Specification:

Column 2, line 3, "cesiumoxid" should read --cesium oxide--.

Column 3, line 53, "induces" should read --indices--.

Column 3, line 58, "output corresponding" should read --output power corresponding--.

UNITED STATES PATENT AND TRADEMARK OFFICE

CERTIFICATE OF CORRECTION

PATENT NO. : 5,578,886

DATED : November 26, 1996

INVENTOR(S) : Holmlid et al.

It is certified that error appears in the above-indentified patent and that said Letters Patent is hereby corrected as shown below:

Column 3, line 60, "expected give" should read --expected to give--.

Signed and Sealed this

Eighth Day of July, 1997

Bruce Lehman

*Attest:*

BRUCE LEHMAN

*Attesting Officer*

*Commissioner of Patents and Trademarks*